US010244843B2

(12) United States Patent
Liu

(10) Patent No.: US 10,244,843 B2
(45) Date of Patent: Apr. 2, 2019

(54) COSMETIC CONTAINER HAVING A FIBROUS APPLICATOR

(71) Applicant: Ting Nan Liu, New Taipei (TW)

(72) Inventor: Ting Nan Liu, New Taipei (TW)

(73) Assignee: ZHUHAI DING RONG PLASTIC PRODUCTS CO., LTD, Zhuhai (CN)

( * ) Notice: Subject to any disclaimer, the term of this patent is extended or adjusted under 35 U.S.C. 154(b) by 68 days.

(21) Appl. No.: 15/599,518

(22) Filed: May 19, 2017

(65) Prior Publication Data

US 2018/0332946 A1 Nov. 22, 2018

(51) Int. Cl.
*A45D 34/04* (2006.01)

(52) U.S. Cl.
CPC ..... *A45D 34/04* (2013.01)

(58) Field of Classification Search
CPC ..... A45D 34/042; A45D 40/262; A45D 2200/10; A45D 2200/1018; A46B 11/0089
USPC ..... 401/262
See application file for complete search history.

(56) References Cited

U.S. PATENT DOCUMENTS 5,551,789 A * 9/1996 Okawa ..... A45D 34/042 401/199
5,971,647 A * 10/1999 Loulourgas ..... B43K 23/124 401/202
7,163,350 B2 * 1/2007 Noguchi ..... A45D 34/042 401/223
7,175,360 B2 * 2/2007 Zhang ..... A45D 34/04 401/186
7,287,927 B2 * 10/2007 Zhang ..... B65D 47/42 401/270
7,488,133 B2 * 2/2009 Kuo ..... A45D 34/042 401/269
7,988,377 B2 * 8/2011 Zhang ..... A45D 40/24 401/186
8,206,051 B2 * 6/2012 Sakurai ..... A45D 34/042 401/269
8,282,302 B2 * 10/2012 Zahn ..... B43K 23/12 401/196
8,297,869 B2 * 10/2012 Gueret ..... A45D 34/04 401/265
8,801,315 B2 * 8/2014 Dwyer ..... A45D 34/042 401/269
9,060,587 B2 * 6/2015 Pschirer ..... A45D 40/262
9,125,470 B2 * 9/2015 Thiebaut ..... A45D 34/04
9,867,444 B1 * 1/2018 Liu ..... A45D 34/042
10,040,082 B1 * 8/2018 Liu ..... B05B 11/0005
(Continued)

*Primary Examiner* — David P Angwin
*Assistant Examiner* — Bradley S Oliver

(57) ABSTRACT

A cosmetic container includes an enclosure including an opening; a cup shaped mount including an externally and internally extending rim disposed on the opening for partially disposing the mount in the opening, at least one port adjacent to a bottom portion, at least one valve each disposed in the port, and a main portion; a spring biased plunger partially disposed in the mount and including an annular flange on an outer surface, an inner case partially disposed in the main portion, a first channel defined by the inner case, an outer case extending outward from the flange, and a second channel defined by the outer case; a fibrous applicator including an application head and a cylindrical fastening member disposed in the second channel, and a tunnel extending through the fastening member into the application head; and a cap. The inner case can open or close the valve.

8 Claims, 6 Drawing Sheets

(56) References Cited

U.S. PATENT DOCUMENTS

| | | | | |
|---|---|---|---|---|
| 2007/0172307 | A1* | 7/2007 | Jo | A45D 34/042<br>401/279 |
| 2009/0269120 | A1* | 10/2009 | Kim | A45D 34/042<br>401/121 |
| 2012/0266907 | A1* | 10/2012 | Chan | A45D 34/042<br>132/218 |
| 2016/0376069 | A1* | 12/2016 | Jung | A45D 34/04<br>401/261 |
| 2017/0079407 | A1* | 3/2017 | Chen | A45D 34/04 |

* cited by examiner

COSMETIC CONTAINER HAVING A FIBROUS APPLICATOR

BACKGROUND OF THE INVENTION

1. Field of the Invention

The invention relates to cosmetic containers and, more particularly, to a cosmetic container which after use and being closed, the unused lotion in the enclosure is prevented from being contaminated by the lotion exposed to the air in the apertures of the fibrous applicator because each valve is closed by a spring biased plunger.

2. Description of Related Art

A conventional cosmetic container is shown in FIG. 6 and comprises an enclosure 80; a cup shaped mount 90 including an externally and internally extending rim 901 provided on the mouth of an opening of the enclosure 80 for disposing the mount 90 in the opening of the enclosure 80, a plurality of ports 902 adjacent to the bottom for communicating the interior of the mount 90 with liquid cosmetic contents stored in the enclosure 80, and an internal space 903; a hollow plunger 92 partially disposed in the mount 90 and including an annular flange 921 on an outer surface and disposed externally of the enclosure 80, an externally extending rim 922 on the outer surface and disposed in the space 903, and an O-ring 923 urging against the rim 922, the outer surface of the plunger 92, and an inner surface of the space 903 for sealing purposes; a torsion spring 94 put on a portion of the plunger 92 between the rim 922 and an internally extending rim shaped member in the mount 90 so that the plunger 92 is adapted to slide in the mount 90; a sleeve 97 mounted on a front portion of the plunger 92 and urging against the flange 921; a hollow carrier 96 partially mounted in the plunger 92 and passing through the sleeve 97 and disposed externally of the sleeve 97, with the carrier 96 communicating with the plunger 92 which in turn communicates with the internal space of the enclosure 80 when the port 902 are open; and a brush 98 disposed on an opening of the carrier 96.

In an application, after opening the cosmetic container, the flange 921 is pushed outward due to the expansion of the energized torsion spring 94. In turn, the ports 902 are open to flow the liquid cosmetic contents to the brush 98 via the ports 902, the plunger 92, and the carrier 96. Finally, a user may use the brush 98 to apply the liquid cosmetic contents to the skin for make-up purposes.

However, the conventional cosmetic container suffers a number of drawbacks as detailed below. It is impossible to uniformly flow the liquid cosmetic contents to the whole brush 98 because the brush 98 is secured to the opening of the carrier 96. Further, it is difficult to grip the cosmetic container to comb the skin by the brush 98, because it is not easy to manipulate the brush 98. The sleeve 97 and the plunger 92 are separate components, i.e., not a unitary component. This can disadvantageously dislodge the sleeve 97 after a period of time of use. In turn, it unfastens the carrier 96. While the O-ring 923 is provided for sealing purposes, it increases friction when sliding the plunger 92. In turn, the sliding movement of the plunger 92 is not smooth.

Thus, the need for improvement still exists.

SUMMARY OF THE INVENTION

It is therefore one object of the invention to provide a cosmetic container comprising an enclosure including an opening; a cup shaped mount including an externally and internally extending rim disposed on the opening of the enclosure for partially disposing the mount in the opening of the enclosure, a bottom portion, at least one port adjacent to the bottom portion, at least one valve each disposed in the at least one port, and a main portion spaced from the bottom portion; a hollow plunger partially disposed in the cup shaped mount and including an annular flange on an outer surface and disposed externally of the enclosure, an inner case partially disposed in the main portion, a first channel defined by the inner case, an outer case extending outward from the annular flange, and a second channel defined by the outer case; a biasing member disposed in the main portion and put on the inner case so that the plunger is configured to slide relative to the mount; a flexible fibrous applicator including an application head and a rear, cylindrical fastening member disposed in the second channel, and a tunnel extending through the rear, cylindrical fastening member into the application head; and a cap releasably secured to the opening of the enclosure. The inner case is configured to open or close the at least one valve.

Preferably, the cap includes a knurled member on an outer surface.

Preferably, the application head includes an arc shaped member, and an opening defined by the arc shaped member and an end of the tunnel.

The invention has the following advantages and benefits in comparison with the conventional art: The spring biased plunger may slide to open the valve after removing the cap. The liquid cosmetic contents in the apertures are prevented from being mixed with the liquid cosmetic contents in the enclosure by flowing back via the tunnel, the first channel, and the closed valves because the valves are blocked. This can prevent the unused liquid cosmetic contents in the enclosure from being contaminated by the liquid cosmetic contents exposed to the air in the apertures. The plunger and the fibrous applicator are fastened together by complimentary grooves and ridges. The fibrous nature of the applicator allows the liquid cosmetic contents to uniformly flow to the outer surface of the fibrous applicator. A user may feel a degree of comfort when the liquid cosmetic contents are applied on the skin due to the nature of the pile on the fibrous applicator.

The above and other objects, features and advantages of the invention will become apparent from the following detailed description taken with the accompanying drawings.

DETAILED DESCRIPTION OF THE INVENTION

Figure 1:
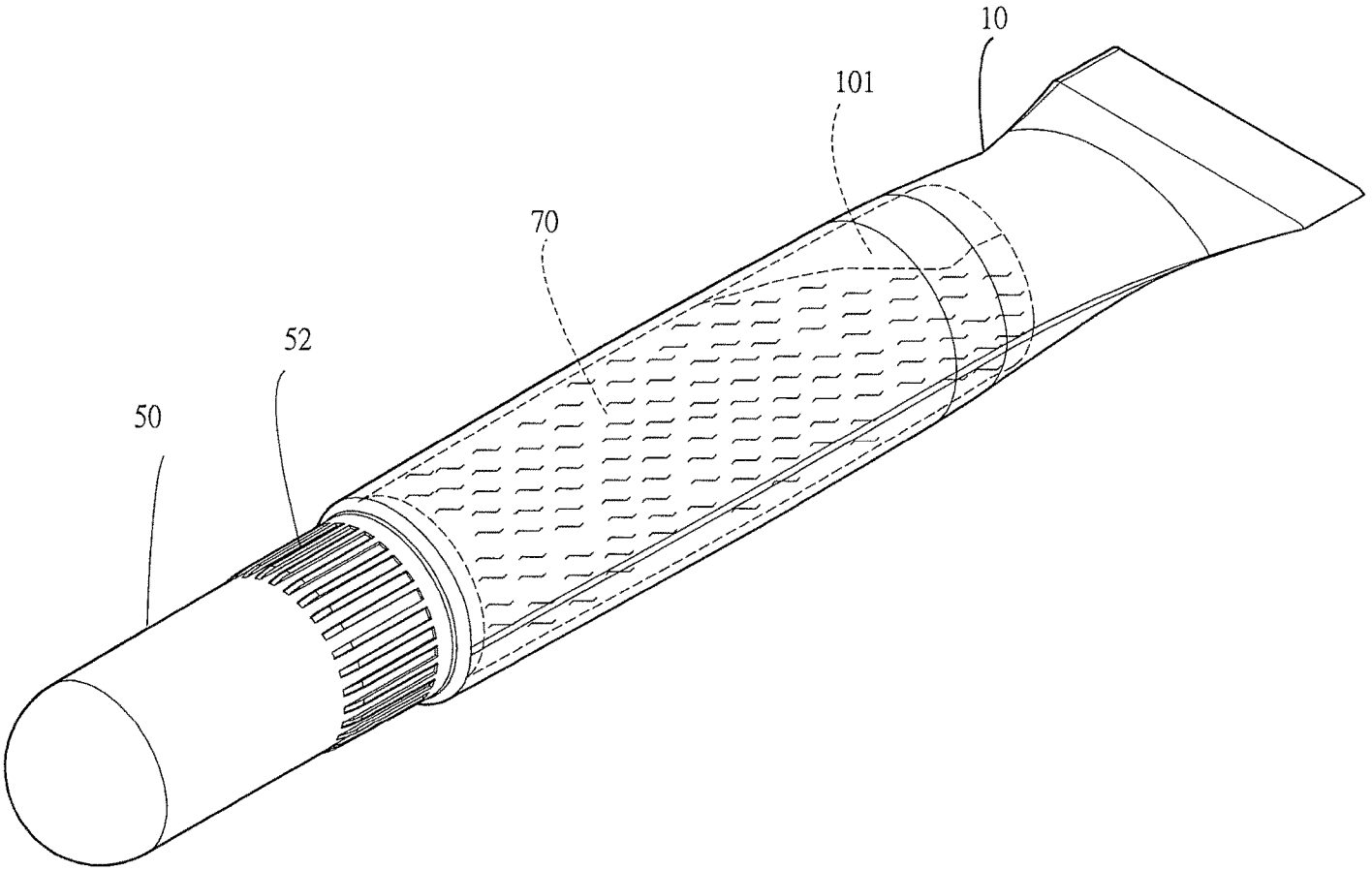
FIG. 1 is a perspective view of a cosmetic container according to the invention.
Figure 2:
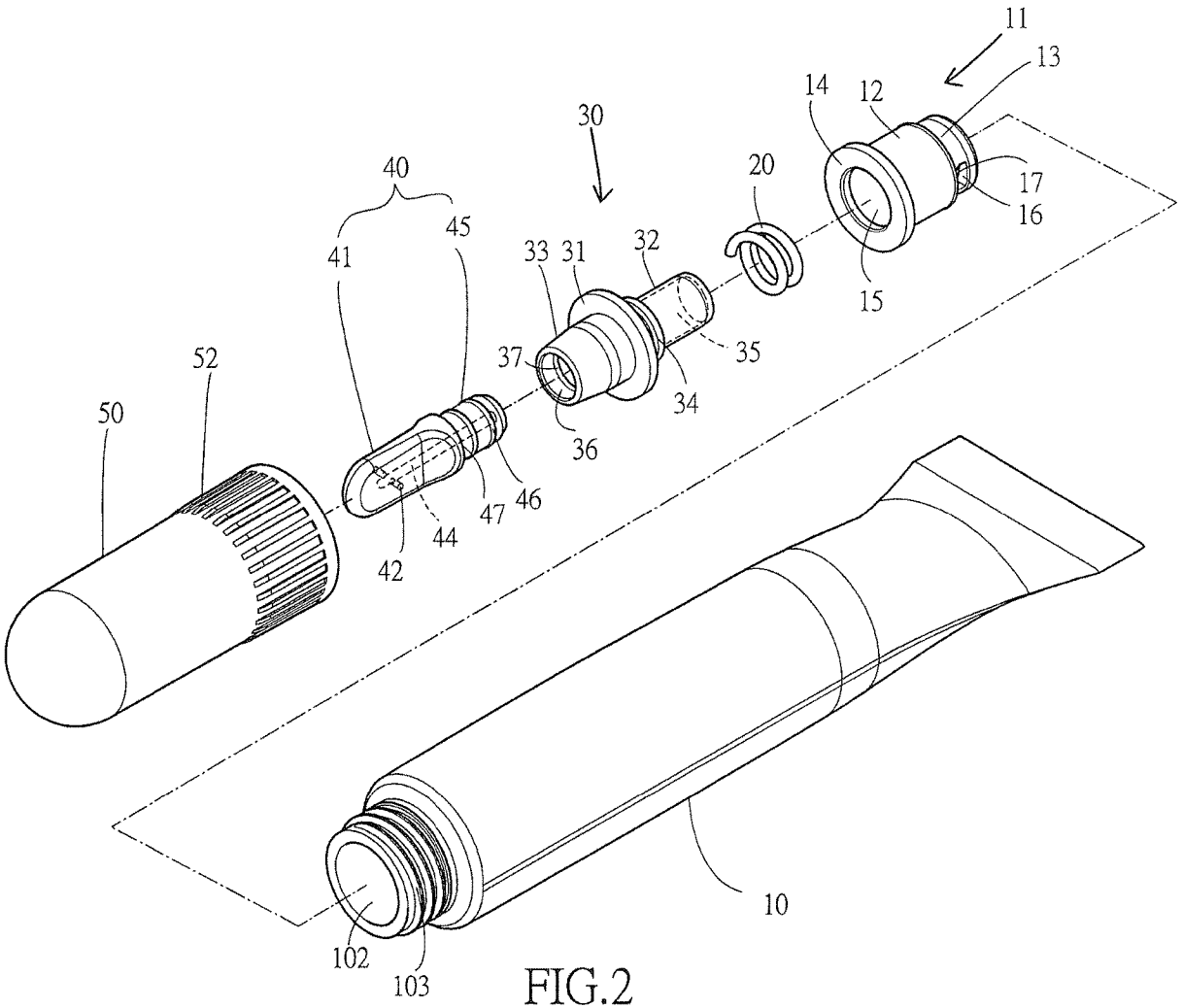
FIG. 2 is an exploded view of the cosmetic container.

Referring to FIGS. 1 to 5, a cosmetic container in accordance with the invention comprises the following components as discussed in detail below.

An enclosure 10 includes an internal space 101 with liquid cosmetic contents (e.g., lotion) 70 stored therein, an opening 102, and threads 103 on an outer surface of the opening 102.

A cup shaped mount 11 includes an externally and internally extending rim 14 provided on the mouth of the opening 102 of the enclosure 10 for disposing the mount 11 in the opening 102 of the enclosure 10, a plurality of ports 16 adjacent to a bottom portion 13 for communicating the interior of the cup shaped mount 11 with the liquid cosmetic contents 70 stored in the enclosure 10, a plurality of valves 17 each provided in the port 16, a main portion 12, and an internal space 15 in the main portion 12 and spaced from the bottom portion 13.

A hollow plunger 30 is partially disposed in the mount 11 and includes an annular flange 31 on an outer surface and disposed externally of the enclosure 10, an inner case 32 partially disposed in the internal space 15, a first channel 35 defined by the inner case 32, an outer case 33 extending outward from the flange 31, a second channel 36 defined by the outer case 33, a plurality of parallel annular grooves 37 on an inner surface of the outer case 33, and an externally extending rim 34 on the outer surface of the inner case 32. The externally extending rim 34 is prevented from being pulled out of the mount 11 when the flange 31 moves away from the externally and internally extending rim 14, because a diameter of the externally extending rim 34 is greater than an inner diameter of the externally and internally extending rim 14.

A biasing member (shown as a torsion spring 20 in this embodiment) is put on a portion of the inner case 32 between the externally extending rim 34 and an internally extending annular member (not numbered) in the mount 11, so that the hollow plunger 30 is adapted to slide relative to the mount 11.

A fibrous applicator 40 is flexible in nature and includes an application head 41, a rear, cylindrical fastening member 45, a plurality of parallel annular ridges 46 on an outer surface of the fastening member 45, an annular shoulder 47 between the application head 41 and the fastening member 45, with the shoulder 47 having an outer diameter greater than an outer diameter of the fastening member 45, and a tunnel 44 extending from a rear end of the fastening member 45 through the fastening member 45 into the application head 41. The fastening member 45 is disposed in the second channel 36 with the annular ridges 46 complementarily disposed in the annular grooves 37 and the shoulder 47 urging against the mouth of the outer case 33, thereby fastening the fibrous applicator 40 and the hollow plunger 30 together. Also, the tunnel 44 communicates with the first channel 35.

Figure 3A:
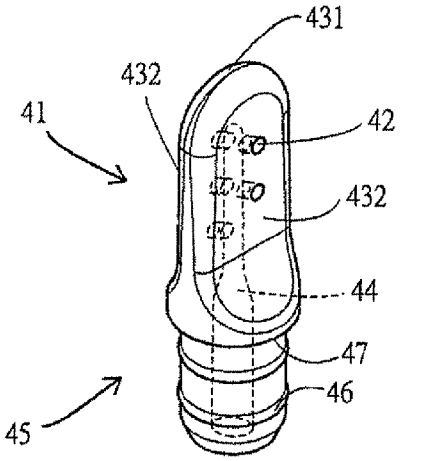
FIG. 3A is a perspective view of a first preferred embodiment of the fibrous applicator.

In a first preferred embodiment of the fibrous applicator 40 as shown in FIG. 3A, the forward application head 41 includes two opposite application surfaces 432 on two surfaces respectively, an arc member 431 between the application surfaces 432, and a plurality of (e.g., five) apertures 42 each having one end communicating with the application surface 432 and the other end communicating with the tunnel 44 for flowing the liquid cosmetic contents 70 out of the fibrous applicator 40 when in use.

Figure 3B:
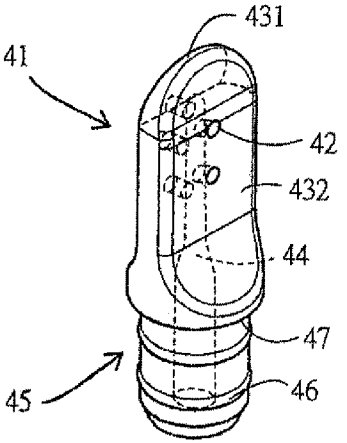
FIG. 3B is a perspective view of a second preferred embodiment of the fibrous applicator.

In a second preferred embodiment of the fibrous applicator 40 as shown in FIG. 3B, the forward application head 41 includes an application surface 432 on one surface, an arc member 431 on an edge of the application surface 432, and a plurality of (e.g., five) apertures 42 each having one end communicating with the application surface 432 and the other end communicating with the tunnel 44 for flowing the liquid cosmetic contents 70 out of the fibrous applicator 40 when in use. The five apertures 42 are arranged differently from the ones shown in FIG. 3A.

Figure 3C:
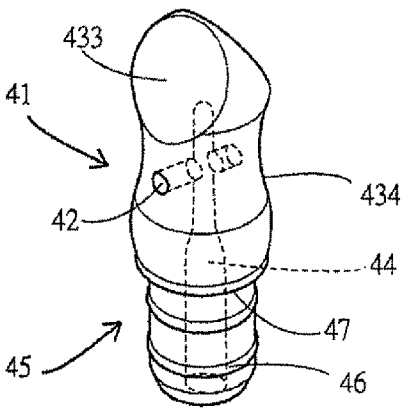
FIG. 3C is a perspective view of a third preferred embodiment of the fibrous applicator.

In a third preferred embodiment of the fibrous applicator 40 as shown in FIG. 3C, the forward application head 41 includes a forward, flat application surface 433, an annular, concave surface 434 adjacent to the application surface 433, and a plurality of (e.g., two) apertures 42 each having one end communicating with the annular, concave surface 434 and the other end communicating with the tunnel 44 for flowing the liquid cosmetic contents 70 out of the fibrous applicator 40 when in use.

Figure 3D:
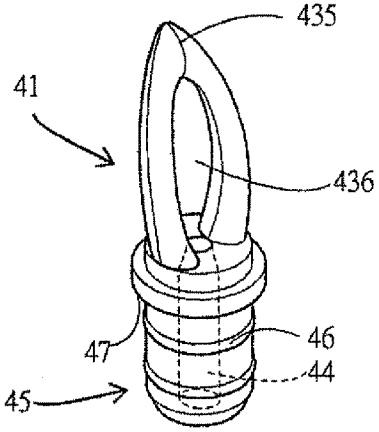
FIG. 3D is a perspective view of a fourth preferred embodiment of the fibrous applicator.

In a fourth preferred embodiment of the fibrous applicator 40 as shown in FIG. 3D, the forward application head 41 includes an arc shaped member 435, and an opening 436 defined by the arc shaped member 435 and an end of the tunnel 44 so that the liquid cosmetic contents 70 may flow out of the tunnel 44 to the opening 436 when in use.

A manufacturing process of the fibrous applicator 40 includes applying an oil based additive on an outer surface of the fibrous applicator 40, placing the fibrous applicator 40 in a pile planting device, and activating the pile planting device to securely plant pile on the fibrous applicator 40 by adhering to the oil based additive. The apertures 42 are not blocked in the pile planting step.

A cap 50 includes an internally threaded section 53 adjacent to a rear end, and a knurled member 52 on an outer surface adjacent to the rear end. The knurled member 52 allows the hand or the fingers to get a better grip on the cap 50 in use. The internally threaded section 53 is secured to the threads 103 in a closed state of the cosmetic container.

Figure 4:
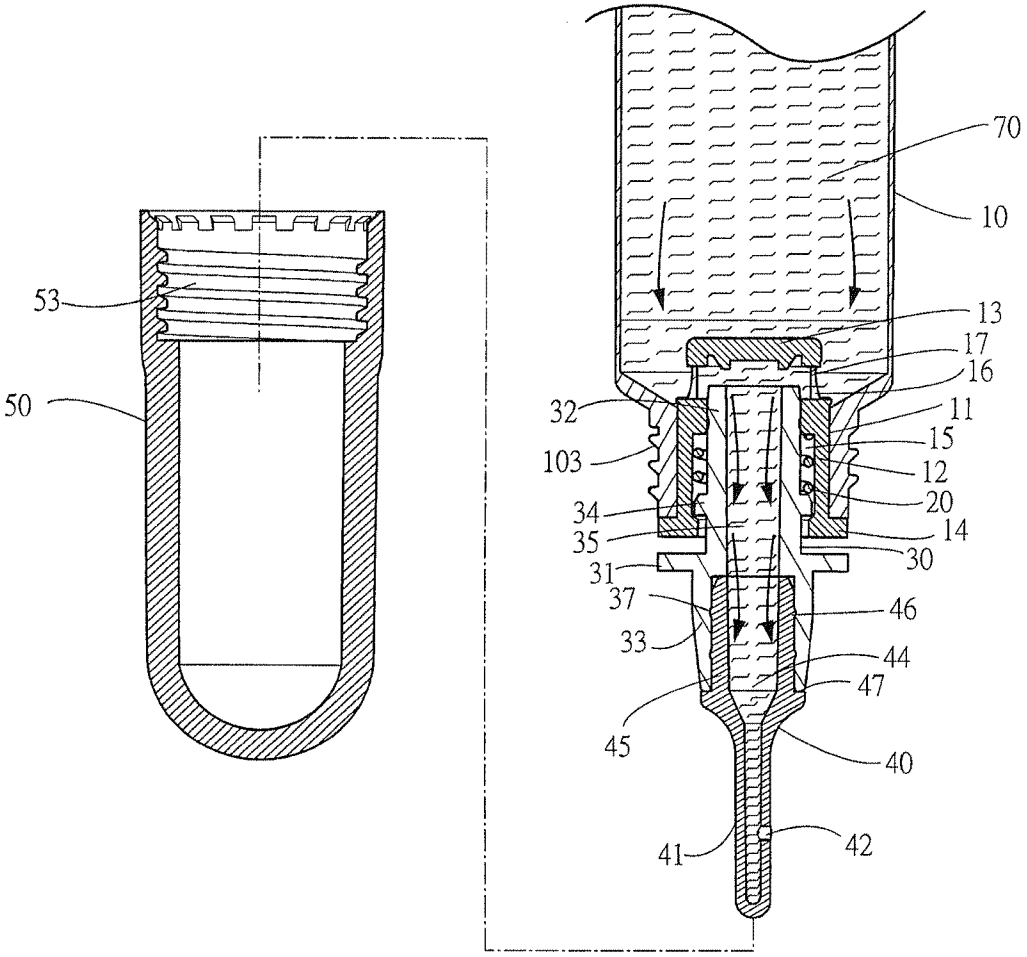
FIG. 4 is a longitudinal sectional view of the cosmetic container in an open, ready to apply state.

As shown in FIG. 4 specifically, the liquid cosmetic contents 70 are stored in the internal space 101. In an open state of the cosmetic container, the cap 50 is removed, the hollow plunger 30 is pushed forward by the expanding torsion spring 20 until the externally extending rim 34 is stopped by the externally and internally extending rim 14, the inner case 32 is also pushed forward to unblock the valves 17, and the liquid cosmetic contents 70 flows out of the apertures 42 via the open valves 17, the first channel 35, and the tunnel 44. The discharged liquid cosmetic contents 70 can be applied to the skin by rubbing the fibrous applicator 40 on the skin.

Figure 5:
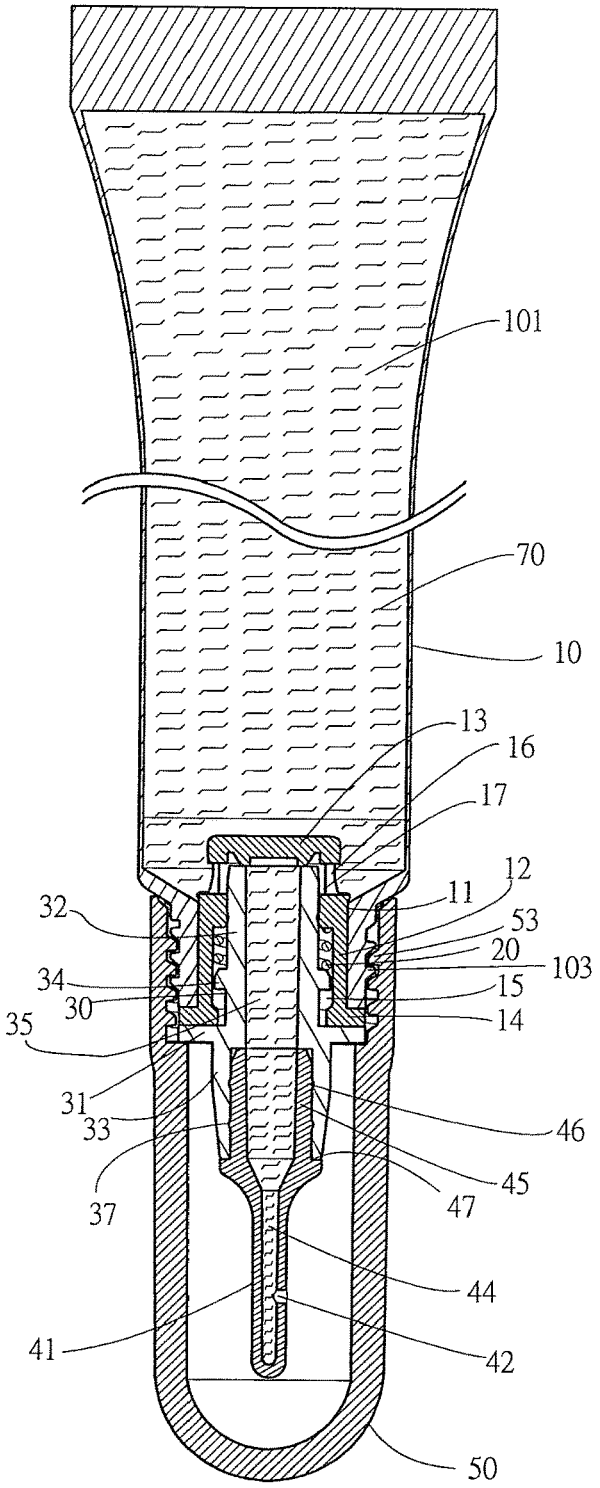
FIG. 5 is a longitudinal sectional view of the cosmetic container in a closed state; and, FIG. 6 is a longitudinal sectional view of a conventional cosmetic container in an open, ready to apply state.
Figure 6:
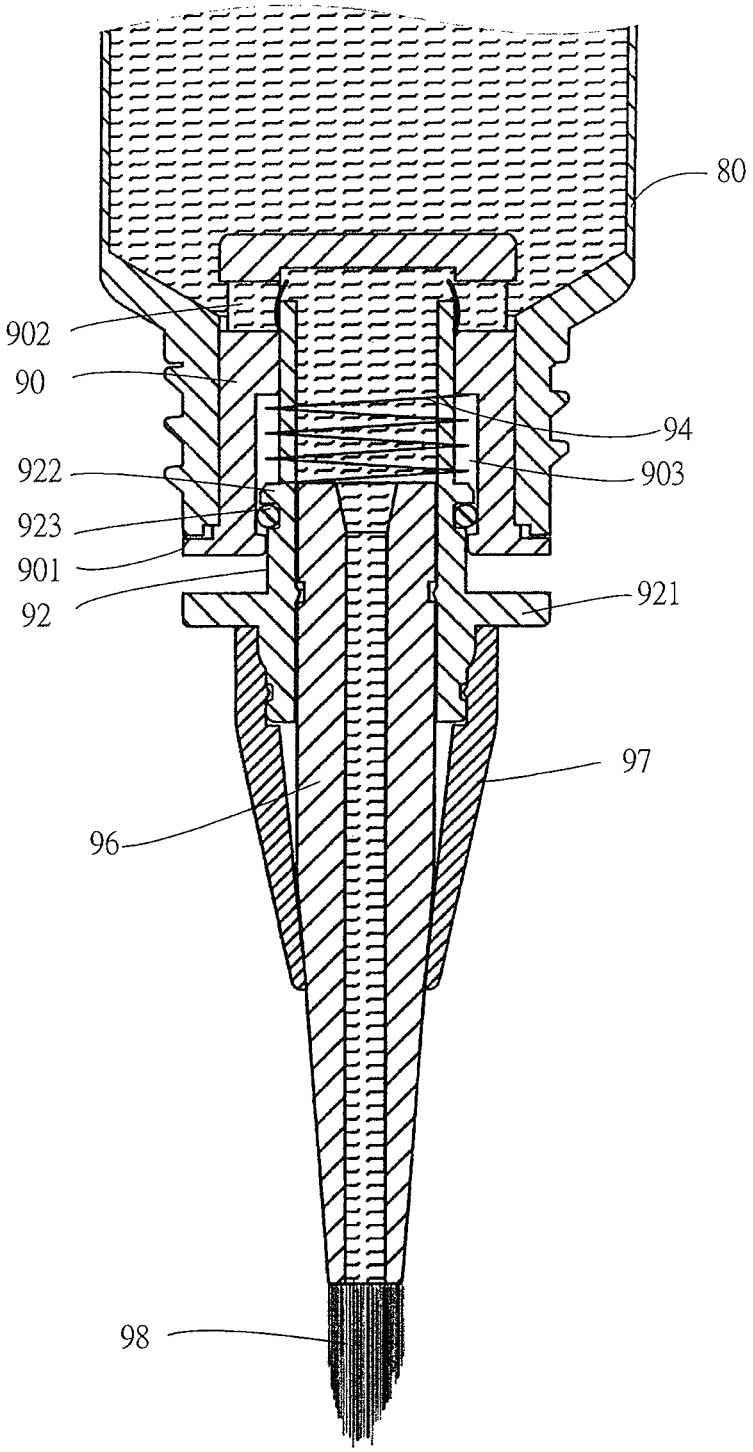
FIG.6 (PRIOR ART)

As shown in FIG. 5 specifically, in a closed state of the cosmetic container, the cap 50 is secured to the enclosure 10 by threadedly fastening the internally threaded section 53 and the threads 103 together, the hollow plunger 30 is pushed rearward with the torsion spring 20 being compressed, and the inner case 32 is also pushed rearward until the valves 17 are blocked.

It is envisaged by the invention that the liquid cosmetic contents 70 in the apertures 42 is prevented from being mixed with the liquid cosmetic contents 70 in the internal space 101 by flowing back via the tunnel 44, the first channel 35, and the closed valves 17 because the valves 17 are blocked (i.e., closed). This has the advantage of preventing the unused liquid cosmetic contents 70 in the internal space 101 from being contaminated by the liquid cosmetic contents 70 exposed to the air in the apertures 42.

While the invention has been described in terms of preferred embodiments, those skilled in the art will recognize that the invention can be practiced with modifications within the spirit and scope of the appended claims.

What is claimed is:

1. A cosmetic container comprising:

an enclosure including an opening;

a cup shaped mount including an externally and internally extending rim disposed on the opening of the enclosure for partially disposing the cup shaped mount in the opening of the enclosure, a bottom portion, at least one port adjacent to the bottom portion, at least one valve each disposed in the at least one port, and a main portion spaced from the bottom portion;

a hollow plunger partially disposed in the cup shaped mount and including an annular flange on an outer surface and disposed externally of the enclosure, an inner case partially disposed in the main portion, a first channel defined by the inner case, an outer case extending outward from the annular flange, and a second channel defined by the outer case;

a biasing member disposed in the main portion and put on the inner case so that the plunger is configured to slide relative to the mount;

a flexible fibrous applicator including an application head and a rear, cylindrical fastening member disposed in the second channel, a tunnel extending through the rear, cylindrical fastening member into the application head, and an annular shoulder between the application head and the rear, cylindrical fastening member, with the shoulder having an outer diameter greater than an outer diameter of the fastening member; and a cap releasably secured to the opening of the enclosure;

wherein the inner case is configured to open or close the at least one valve.

2. The cosmetic container of claim 1, wherein the hollow plunger further comprises at least one annular groove on an inner surface of the outer case, wherein the flexible fibrous applicator further comprises at least one annular ridge on an outer surface of the rear, cylindrical fastening member, with the at least one annular ridge being complementarily disposed in the at least one annular groove.

3. The cosmetic container of claim 1, wherein the cap includes a knurled member on an outer surface.

4. The cosmetic container of claim 1, wherein the application head includes at least one aperture communicating with the tunnel.

5. The cosmetic container of claim 1, wherein the application head includes two opposite application surfaces on two surfaces respectively, and an arc member between the two opposite application surfaces.

6. The cosmetic container of claim 1, wherein the application head includes an application surface on one surface, and an arc member on an edge of the application surface.

7. The cosmetic container of claim 1, wherein the application head includes a flat application surface, and an annular, concave surface adjacent to the flat application surface.

8. The cosmetic container of claim 1, wherein the application head includes an arc shaped member, and an opening defined by the arc shaped member and an end of the tunnel.

* * * * *